United States Patent [19]

Carrillo

[11] Patent Number: 4,602,494

[45] Date of Patent: Jul. 29, 1986

[54] APPARATUS FOR ADJUSTING CONTACT SPACING

[76] Inventor: Leo Carrillo, 6895 Alan Dr., Denver, Colo. 80221

[21] Appl. No.: 801,134

[22] Filed: Nov. 22, 1985

[51] Int. Cl.[4] ..... B21D 17/02

[52] U.S. Cl. ..... 72/384; 29/741; 29/758; 29/764

[58] Field of Search ..... 72/384, 386, 387, 409; 29/741, 758, 764

[56] References Cited

U.S. PATENT DOCUMENTS 3,673,384 6/1972 Burman et al. ..... 219/230

3,797,092 3/1974 Einarson ..... 29/203 H

*Primary Examiner*—Leon Gilden

[57] ABSTRACT

The subject contact adjusting apparatus functions to precisely adjust the spacing between the two parallel arms of F-shaped contacts. The contacts are placed in a cutout in the top surface of a platen with the base of the contacts resting against a contact positioning guide that protrudes from the top surface of the platen, where the two parallel arms of the contacts face upward. A movable contact retention head is then lowered into place to hold the contacts in alignment. The contact adjustment head is activated, pliers fashion, to adjust the spacing between the two parallel arms of the contacts.

12 Claims, 12 Drawing Figures

APPARATUS FOR ADJUSTING CONTACT SPACING

FIELD OF THE INVENTION

This invention relates to circuit packs (printed circuit boards) which are equipped with a daughter board and, in particular, to a contact adjusting tool for adjusting the spacing on the contacts which hold the daughter board to the circuit pack.

BACKGROUND OF THE INVENTION

Daughter boards are used on circuit packs to piggyback additional circuitry on to the circuit pack or to provide a land area for prototype circuits. The daughter board is electrically connected to the circuit pack by a pattern of F-shaped contacts that are connected to contact areas along the edges of the daughter board. The vertical portion of each F-shaped contact is connected to a mating area on the surface of the circuit pack while the contact areas on the edge of the daughter board fit between the horizontal arms of the F-shaped contact. The horizontal arms of the F-shaped contact are set a predetermined distance apart to match the thickness dimension of the daughter board.

A difficulty with this arrangement is that the spacing between the horizontal arms of the F-shaped contacts is not very easily adjusted. Therefore, for various thickness daughter boards different F-shaped contacts must be fabricated. Any significant deviation in the thickness of the daughter board will cause the F-shaped contacts not to make electrical connection to the contact areas on the daughter board. Manual adjustment of the horizontal arms of the F-shaped contacts is difficult, imprecise and costly.

DESCRIPTION OF THE INVENTION

The subject contact adjusting apparatus functions to precisely adjust the spacing of the horizontal arms of the F-shaped contacts to account for different thickness daughter boards. This adjustment is accomplished by placing a strip of the F-shaped contacts flat on the top surface of a platen, with the base of the contacts resting against a contact positioning guide that protrudes from the top surface of the platen, where the horizontal arms of the F-shaped contacts face upward. A movable contact retention head is then lowered into place against the contact strip to hold the contacts in alignment. The movable contact adjusting head is then activated, pliers fashion, to adjust the spacing of the horizontal arms of the contacts. An adjustable stop on the movable contact adjusting head of the contact adjusting apparatus precisely sets the contact spacing. In this fashion, the subject contact adjusting apparatus can precisely adjust the spacing of the horizontal arms of the F-shaped contacts without requiring a significant amount of manual labor.

DETAILED DESCRIPTION

Figure 11:
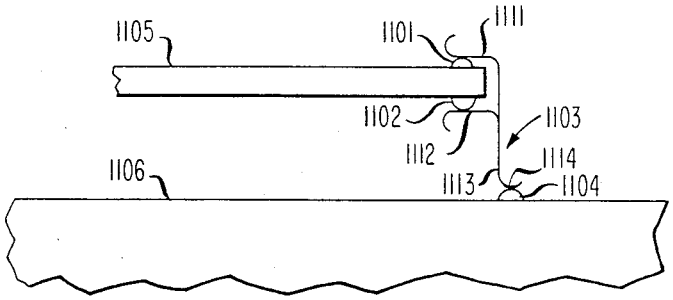
FIG. 11 illustrates a side view of an F-shaped contact connecting a daughter board to a circuit pack.

Daughter boards are used on circuit packs to piggyback additional circuitry on to the circuit pack or to provide a land area for prototype circuits. The daughter board is electrically connected to the circuit pack by a pattern of F-shaped contacts that are connected to contact areas along the edges of the daughter board. As illustrated in FIG. 11, the vertical portion 1113 of each F-shaped contact 1103 is connected to a mating area 1104 on the surface of the circuit pack 1106 while the contact areas 1101, 1102 on the edge of the daughter board 1105 fit between the horizontal arms 111, 1112 of the F-shaped contact 1103. The horizontal arms 1111, 1112 of the F-shaped contact are set a predetermined distance apart to match the thickness dimension of the daughter board 1105.

Figure 1:
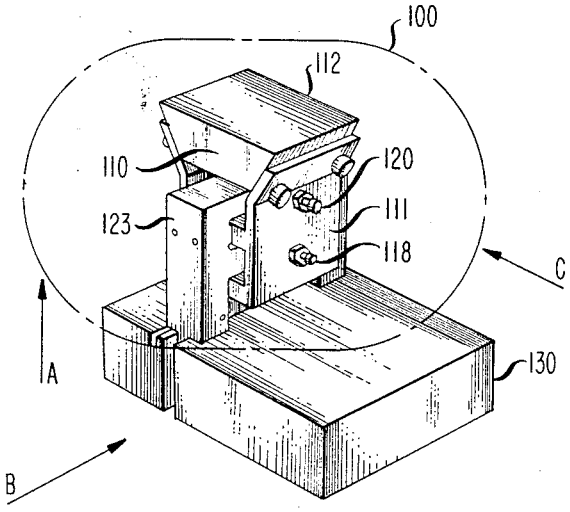
FIG. 1 illustrates a perspective view of the subject contact adjusting apparatus.

FIG. 1 illustrates the subject contact adjusting apparatus in perspective view. This apparatus consists of a platen 130 and a movable contact adjusting head 100. The movable contact adjusting head 100 fits on platen 130 in predetermined spaced relationship such that a strip of F-shaped contacts can be inserted on platen 130 under the contact adjusting head 100 of the apparatus. The movable contact adjusting head 100 consists of a support frame 123 which inserts into an alignment slot in platen 130. The movable plier-like contact adjusting arms 110 and 111 are pivotally connected to support frame 123 and are operated by a trapezoidal-shaped block 112. When a downward force is placed on block 112, contact adjusting arms 110 and 111 are spread apart causing the adjusting jaws of the tool to close a predetermined distance. The range of movement of contact adjusting arms 110 and 111 are controlled by adjusting screws 118 and 120.

Figure 2:
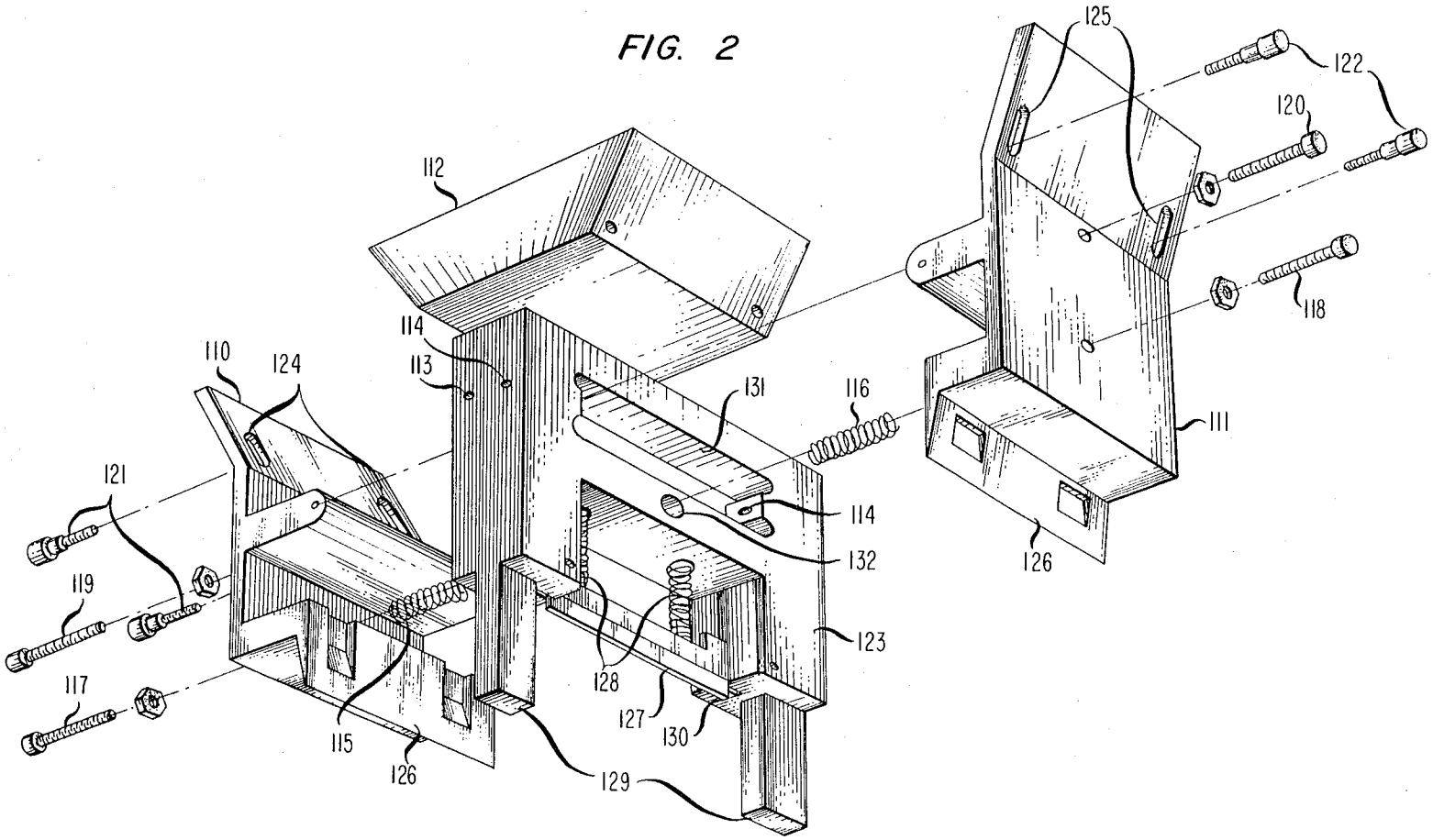
FIG. 2 illustrates an exploded diagram of the movable contact adjusting head of the contact adjusting apparatus.
Figure 4:
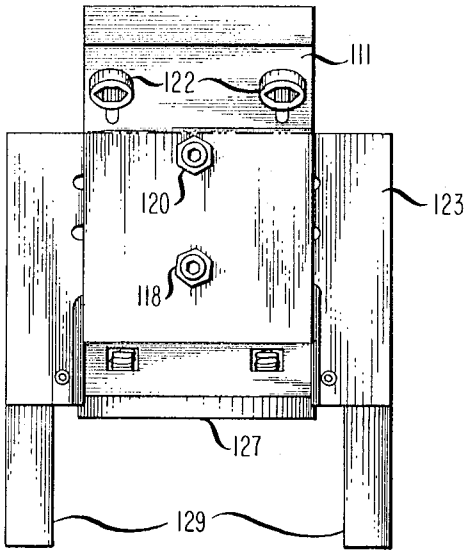
FIGS. 3–6 illustrate top, side and bottom views of the movable contact adjusting head of the contact adjusting apparatus.
Figure 3:
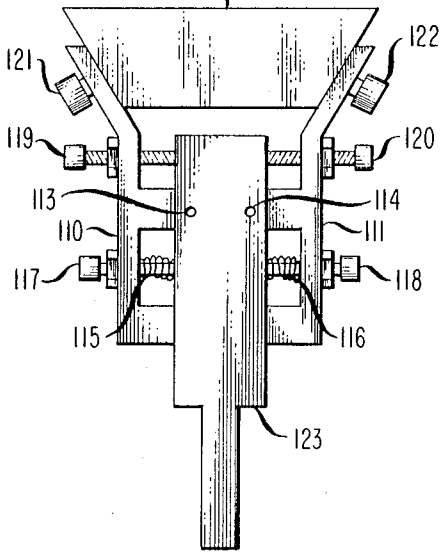
Figure 5:
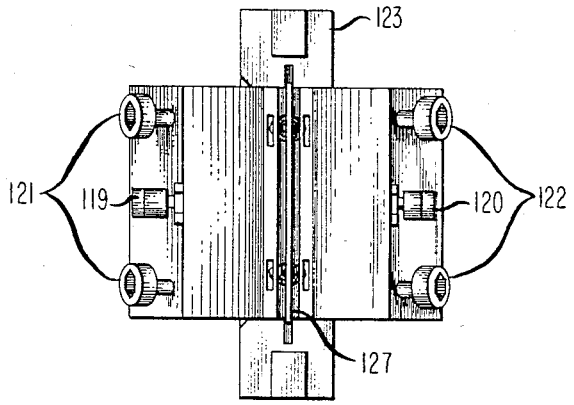
Figure 6:
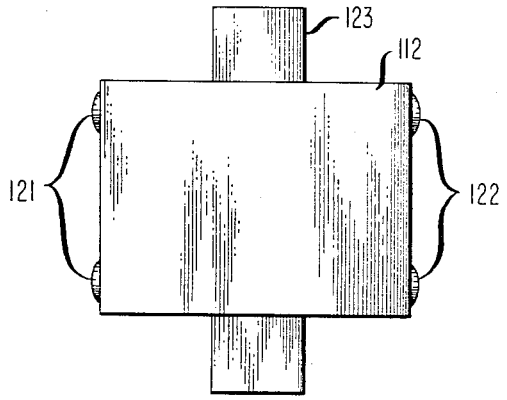
Figure 7:
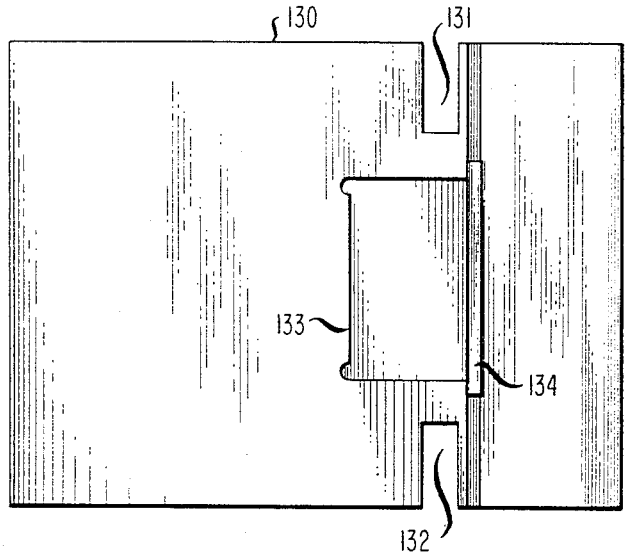
FIGS. 7–10 illustrate top, side and bottom views of the platen of the contact adjusting apparatus.
Figure 8:
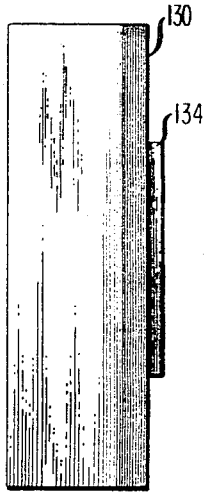
Figure 9:
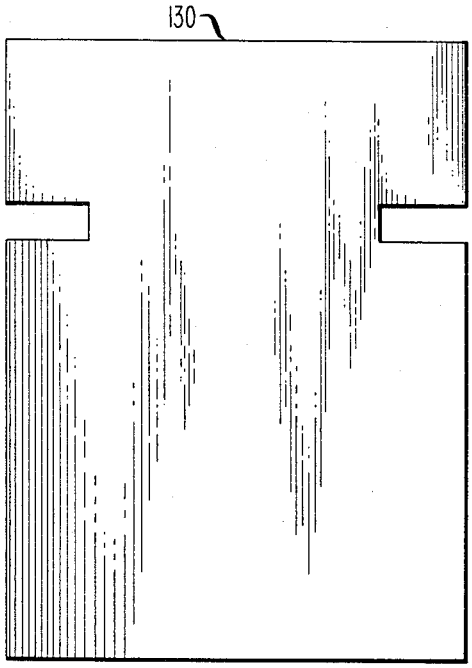
Figure 10:
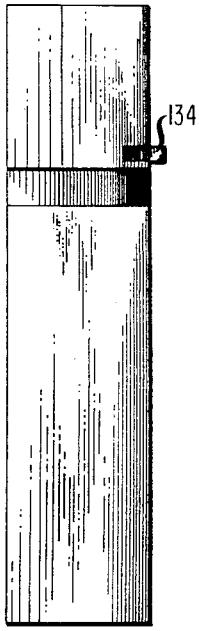

The operation of the contact adjusting apparatus can better be understood by reference to the exploded view of contact adjusting head 100 illustrated in FIG. 2. Reference to FIGS. 3–10 can concurrently be made since FIG. 3 shows an end view of movable contact adjusting head 100, while FIG. 4 shows a side view of movable contact adjusting head 100, FIG. 5 shows a bottom view of movable contact adjusting head 100 and FIG. 6 shows a top view of movable contact adjusting head 100. FIG. 7 shows a top view of platen 130 while FIG. 8 shows an end view of platen 130, FIG. 9 shows a top view of platen 130, FIG. 10 shows a side view of platen 130.

APPARATUS STRUCTURE

The movable contact adjusting head 100 consists of a frame 123 that is shaped like a block-type letter "A". Frame 123 includes two alignment arms 129 that fit into matching slots 131, 132 cut into platen 130. Contact adjusting head 100 is moved away from platen 130 (in direction A shown on FIG. 1) to insert a strip of the contacts on platen 130 under contact adjusting head 100. Contact adjusting head 100 is then moved in the opposite direction to come into contact with platen 130. Alignment arms 129 in matching slots 131, 132 prevent contact adjusting head 100 from moving with respect to platen 130 in directions B and C.

Figure 12:
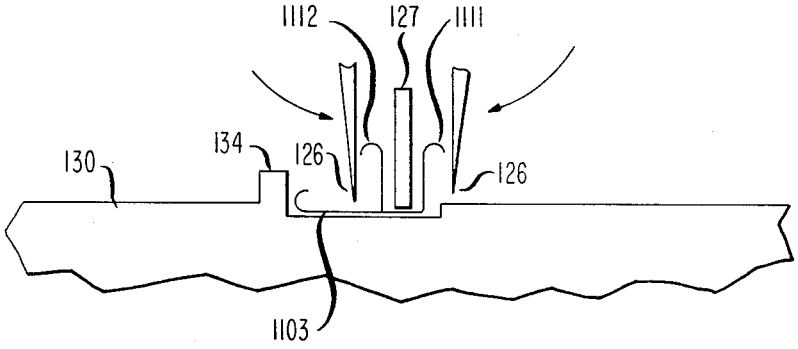
FIG. 12 illustrates a side view of an F-shaped contact positioned in the subject contact adjusting apparatus.

Platen 130 includes a contact positioning guide 134 that protrudes from the surface of the platen and against which a strip of the F-shaped contacts 1103 are placed. The strip of F-shaped contacts 1103 are placed into depression 133 cut into the base of platen 130 (see FIG. 12), with the base 1114 of the F-shaped contacts 1103 resting against contact positioning guide 134 that protrudes from the top surface of platen 130 with the horizontal arms 1111, 1112 of the F-shaped contacts 1103 facing up. The movable contact adjusting head 100 of the apparatus is then lowered into place so that the movable contact retention head 127 rests against the vertical portion 1113 of the contact strip to hold the contact strip in place by the force applied to the movable contact retention head 127 by springs 128.

APPARATUS OPERATION

The adjustment of the spacing of the horizontal arms 1111, 1112 of the F-shaped contacts 1103 is accomplished by the movable contact adjusting arms 110 and 111 which operate in pliers fashion to readjust the alignment of the horizontal arms 1111, 1112 of the F-shaped contacts 1103. Movable contact adjusting arms 110 and 111 are attached in pivotal fashion to frame 123 by way of pins through holes 113 and 114 which are drilled in the sides of frame 123. Movable contact adjusting arms 110 and 111 when forced outward at the top portion thereof, away from frame 123, cause movable contact adjusting arms 110 and 111 to close plier-fashion so that the jaws 126 of movable contact adjusting arms 110 and 111 close together (see FIG. 12) to adjust the spacing between the horizontal arms 1111, 1112 of the F-shaped contacts 1103 which are held in place by movable contact retention head 127.

The movement of movable contact adjusting arms 110 and 111 is accomplished in precise, controlled fashion by block 112, which is a trapezoidal shaped piece of metal attached by screws 122 to the upper portion of movable contact adjusting arms 110 and 111 through slots 124 and 125, respectively, cut in contact adjusting arms 110 and 111. Thus, block 112 can be moved in a vertical direction through a range of motion determined by the length of slots 124 and 125. Movable contact adjusting arms 110 and 111 are shaped so the top portion thereof is angled away from the vertical line of frame 123. Thus, block 112 acts as a wedge when operated in a downward fashion, forcing the top portion of contact adjusting arms 110 and 111 apart causing contact adjusting arms 110 and 111 to pivot around pins 113 and 114 in pliers fashion causing jaws 126 to close a predetermined amount.

RANGE OF MOTION ADJUSTMENT

The exact movement of jaws 126 is controlled by adjusting screws 119, 120 and 117, 118. Screws 117 and 118 are attached through holes in the lower portion of movable contact adjusting arms 110 and 111 and extend into a mating hole 132 cut in frame 123. Screws 117, 118 control the distance that movable contact adjusting arms 110, 111 close together. In particular, screws 117, 118 make contact with frame 123 to prevent was 110, 111 from being operated more than a predetermined amount. Coil springs 115 and 116 are provided in coaxial fashion around screws 117 and 118 to force contact adjusting arms 110 and 111 into the unoperated rest position where jaws 126 are spread apart. Adjusting screws 119 and 120 protrude through holes drilled in the upper portion of movable contact adjusting arms 110 and 111 to control the distance that movable contact adjusting arms 110 and 111 travel to the return position. In particular, screws 119 and 120 make contact with the surface of frame 123 to prevent the upper portion of movable contact adjusting arms 110 and 111 from being closed any more than a predetermined distance. Thus, when jaws 126 are spread apart the distance that these two jaws are separated is determined by how far screws 119 and 120 protrude through movable contact adjusting arms 110 and 111. Once screws 119 and 120 make contact with frame 123 the movable contact adjusting arms 110 and 111 can be pivoted no further. Thus, screws 119 and 120 determine the open distance between jaws 126 while screws 117 and 118 determine the closed separation between jaws 126. In this fashion, the subject contact adjusting apparatus can control the spacing between the horizontal arms of an entire strip of the F-shaped contacts in very precise fashion without requiring a significant amount of manual effort.

It is obvious that while the tool has been illustrated for use with a single predetermined strip of contacts it can easily be automated to operate on a continuous feed strip of the F-shaped contacts so that a portion of the contact strip is automatically fed under movable contact retention head 127, block 112 is operated to cause movable contact adjusting arms 110 and 111 to close adjusting these contacts. Then, the strip of contacts is moved to the next segment of unadjusted contacts are under the movable contact retention head 127 and the contact adjusting apparatus is again operated. In this fashion this contact adjusting apparatus can be used to quickly and precisely adjust the spacing between the horizontal arms of an entire strip of the F-shaped contacts. The adjustment capability provided by adjusting screws 117 and 118 permit the contact adjusting apparatus to quickly be readjusted to account for a different thickness daughter board.

While a specific embodiment of the invention has been disclosed, variations in structural detail, within the scope of the appended claims, are possible and are contemplated. There is no intention of limitation to what is contained in the abstract or the exact disclosure as herein presented. The above-described arrangements are only illustrative of the application of the principles of the invention. Normally, other arrangements may be devised by those skilled in the art without departing from the spirit and the scope of the invention.

What is claimed is:

1. A contact adjusting apparatus for adjusting the spacing between the horizontal arms of F-shaped contacts comprising:
   - means (130) for positioning said contacts with said horizontal arms in a first direction (A);
   - contact adjusting means (100) connected to said positioning means (130) for adjusting the spacing of said horizontal arms including:
     - first adjustment arm (100) having an actuating portion and a jaw portion (126),
     - second adjustment arm (111) having an actuating portion and a jaw portion (126),
     - wherein said first (110) and said second (111) adjustment arms are pivotally connected to said positioning means (130) at a point between their respective actuating and jaw (126) portions to render said adjustment arms (110, 111) operable in pliers fashion in alignment with said first direction (A) and in proximate relation to said horizontal arms of said contacts, and means (112, 115–122) connected to both said first (110) and said second (111) adjustment arms for adjustably controlling the range of motion of said jaw portion (126) of said first (110) and said second (111) adjustment arms to bend said horizontal arms of said contacts to a desired position.

2. The apparatus of claim 1 wherein said positioning means (130) includes:

guide means (134) protruding from the surface of said positioning means (130) in said first direction (A) for providing a stop against which the contacts abut; and cutout means (133) cut into the surface of said positioning means (130) adjacent to said guide means (134) into which said contacts are placed for holding said contacts in position against said guide means (134).

3. The apparatus of claim 2 wherein said contact adjusting means (100) includes:

contact retention means (127) operable to engage said contacts at a point between said two parallel horizontal arms to hold said contacts in a fixed position against the bottom of said cutout means (133).

4. The apparatus of claim 1 including:

means (131, 132) in said positioning means (130) for providing a guide channel aligned in said first direction (A); and means (129) in said contact adjusting means (100) of size and shape to be insertable into said guide channel means (131, 132) for enabling said contact adjusting means (100) to be controllably moved in said first direction (A) into contact with said positioning means (130).

5. The apparatus of claim 1 wherein said adjustably controlling means (112, 115–122) includes:

spring means (115, 116) connected to both said adjustment arms (110, 111) to urge said adjustment arms (110, 11) apart so said jaw portions (126) of said adjustment arms (110, 111) are normally forced apart;

stop means (119, 120) connected to both said adjustment arms (110, 111) for constraining the lateral movement of said adjustment arms (110, 111) apart a predetermined distance; and second stop means (117, 118) connected to both said adjustment arms (110, 111) for constraining the lateral closing movement of said adjustment arms (110, 111) to a controllable predetermined distance.

6. The apparatus of claim 5 wherein said contact adjustment means (100) includes:

block means (112) having a trapezoidal shape and movable in said first direction (A) to concurrently contact said actuating portion of both said first and said second adjustment arms (110, 111) to force said actuating portion of said first and said second adjustment arms (110, 111) apart an equal amount.

7. A contact adjusting apparatus for adjusting the spacing between two parallel arms of a set of contacts comprising:

means (130) for securing said contact set in a predetermined position with said two parallel arms oriented in a first direction (A);

means (100) connected to said securing means (130) for adjusting the spacing between said parallel arms of said contact set including:

first adjustment arm (110) having an actuating portion and a jaw portion (126), second adjustment arm (111) having an actuating portion and a jaw portion (126), means (113, 114, 123) for pivotally connecting said first (110) and said second (111) adjustment arms together at a point between their respective actuating and jaw (126) portions in pliers fashion, wherein said connecting means (113, 114, 123) are operable to position in said first direction (A) said jaw portion (126) of said first (110) and said second (111) adjustment arms in proximate relation to said two parallel arms of said contact set, and means (112, 115–122) for moving said actuating portion of said first (110) and said second (111) adjustment arms a precisely determined distance apart, thereby moving said jaw portion (126) of said first (110) and said second (111) adjustment arms together a precisely determined distance to bend said two parallel arms of said contact set to a desired position.

8. The apparatus of claim 7 wherein said securing means (130) includes:

guide means (134) protruding from the surface of said securing means (130) in said first direction (A) for providing a stop against which the contacts abut; and cutout means (133) cut into the surface of said securing means (130) adjacent to said guide means (134) into which said contacts are placed for holding said contacts in position against said guide means (134).

9. The apparatus of claim 8 wherein said contact adjusting means (100) includes:

contact retention means (127) operable to engage said contacts at a point between said two parallel horizontal arms to hold said contacts in a fixed position against the bottom of said cutout means (133).

10. The apparatus of claim 7 including:

means (131, 132) in said securing means (130) for providing a guide channel aligned in said first direction (A); and means (129) in said contact adjusting means (100) of size and shape to be insertable into said guide channel means (131, 132) for enabling said contact adjusting means (100) to be controllably moved in said first direction (A) into contact with said securing means (130).

11. The apparatus of claim 7 wherein said adjustably controlling means (112, 115–122) includes:

spring means (115, 116) connected to both said adjustment arms (110, 111) to urge said adjustment arms (110, 111) apart so said jaw portions (126) of said adjustment arms (110, 111) are normally forced apart;

stop means (119, 120) connected to both said adjustment arms (110, 111) for constraining the lateral movement of said adjustment arms (110, 111) apart a predetermined distance; and second stop means (117, 118) connected to both said adjustment arms (110, 111) for constraining the lateral closing movement of said adjustment arms (110, 111) to a controllable predetermined distance.

12. The apparatus of claim 11 wherein said contact adjustment means (100) includes:

block means (112) having a trapezoidal shape and movable in said first direction (A) to concurrently contact said actuating portion of both said first (110) and said second (111) adjustment arms to force said actuating portion of said first (110) and said second (111) adjustment arms apart an equal amount.

* * * * *

UNITED STATES PATENT AND TRADEMARK OFFICE

CERTIFICATE OF CORRECTION

PATENT NO. : 4,602,494

DATED : July 29, 1986

INVENTOR(S) : Leo Carrillo

It is certified that error appears in the above-identified patent and that said Letters Patent is hereby corrected as shown below:

On the title page of the issued patent please add: --Assignee: AT&T Information Systems Inc., Holmdel, N. J.; Attorney of Record, James M. Graziano--.

Signed and Sealed this

Twenty-eighth Day of April, 1987

*Attest:*

DONALD J. QUIGG

*Attesting Officer*

*Commissioner of Patents and Trademarks*